United States Patent [19]

Johnson et al.

[11] 4,046,320

[45] Sept. 6, 1977

[54] FIREPLACE BOILER HEATING SYSTEM FOR HOT WATER TYPE FURNACES

[76] Inventors: William A. Johnson, 12406 Taylorsville Road, Louisville, Ky. 40299; Roy O. Johnson, 12015 Donohue Ave., Louisville, Ky. 40243

[21] Appl. No.: 688,619

[22] Filed: May 21, 1976

Related U.S. Application Data

[63] Continuation-in-part of Ser. No. 573,897, May 2, 1975, abandoned.

[51] Int. Cl.[2] ..... F24D 3/02; F24B 9/04

[52] U.S. Cl. ..... 237/8 C; 237/51; 237/63; 126/132

[58] Field of Search ..... 237/8 R, 8 C, 63, 5; 165/DIG. 2; 126/132, 271

[56] References Cited

U.S. PATENT DOCUMENTS

| | | | |
|---|---|---|---|
| 556,807 | 3/1896 | Connell et al. | 126/132 |
| 670,066 | 3/1901 | Smoak | 126/132 |
| 1,352,371 | 9/1920 | Kenney | 126/132 |
| 1,576,899 | 3/1926 | Clanton | 126/132 |
| 2,048,675 | 7/1936 | Baruch et al. | 126/132 |
| 3,958,755 | 5/1976 | Cleer, Jr. | 237/8 R |

*Primary Examiner*—William E. Wayner
*Assistant Examiner*—William E. Tapolcai, Jr.
*Attorney, Agent, or Firm*—Maurice L. Miller, Jr.

[57] ABSTRACT

A water boiler adapted for use in a fireplace is disclosed having an inlet header pipe, an outlet header pipe, and a series of pipes disposed parallel to one another and connected between the inlet and the outlet header pipes. The series of pipes is fashioned so as to form a grate suitable for supporting a log fire, including a horizontal portion upon which the logs may be supported and a remaining portion which extends upward along the rear wall of the fireplace through an arc back toward the top front of the fireplace, whereby heat rising from the fire passes between the series of pipes for added boiler efficiency.

A heating system using the fireplace boiler and operating in conjunction with a conventional residential heating system is also disclosed. The fireplace boiler contributes heat a conventional furnace to reduce the amount of energy consumed by the latter.

8 Claims, 3 Drawing Figures

FIREPLACE BOILER HEATING SYSTEM FOR HOT WATER TYPE FURNACES

CROSS-REFERENCE TO RELATED APPLICATION

This application is a continuation-in-part of our previously filed co-pending application entitled, "Fireplace Boiler and Heating System Utilizing the Same," Ser. No. 573,897, filed May 2, 1975, now abandoned.

BACKGROUND OF THE INVENTION

This invention relates generally to fireplace boilers and to heating systems for homes and other buildings which employ such boilers.

The general concept of a fireplace boiler is known in the prior art. For example, U.S. Pat. No. 1,576,899 issued to John B. Clanton on Mar. 16, 1926 discloses a coiled water pipe adapted for disposition in a fireplace for the purpose of absorbing heat from a fire to heat water therein, which water is, in turn, conveyed directly to hot water registers or radiators located throughout a house, remote from the fireplace. A series of the baffle plates is also disclosed which are adapted to divert heat from the fire, across the coiled water pipe, which would otherwise escape up the chimney.

The above-described boiler does not contain means for supporting the fire thereon. Moreover, it is complicated by the use of baffle plates to divert heat across the coils, which coils are not disposed in the direct line of heat from the fire. Another problem with such a fireplace boiler is that it is impractical to rely entirely upon the same to heat the modern home, especially where such homes are usually equipped with thermostatically controlled gas, oil or coal fired or electrically heated hot water furnace boilers. Homeowners rarely find it convenient to tend a fire in the fireplace on a continuous basis, even in the most bitter cold weather, a necessary activity where heat for the home depends entirely upon a fireplace boiler system.

However, we have found that, when the fireplace is in use, it is entirely practical and highly desirable from an energy savings standpoint to utilize heat generated in the fireplace to supplement or contribute to the heat generated in the main home heating system, including the conventional boiler furnace employed therein. In fact, we have developed a fireplace boiler and heating system which can readily heat the entire home by itself when the fireplace is operative so that little or no fuel is consumed by the furnace from its ordinary commercial energy source. The result is a substantial energy savings to the homeowner over the winter months, which is highly desirable not only in terms of costs to the homeowner, but also in terms of energy savings to the nation in general.

Our invention substantially overcomes these and other difficulties encountered in prior art fireplace boilers and provides an efficient and practical auxiliary heating system for the home and other buildings.

SUMMARY OF THE INVENTION

It is an object of the subject invention to provide a fireplace boiler adapted for efficient absorption of heat from an open fire.

It is a further object of the subject invention to provide a fireplace boiler which has a pleasing appearance and which forms a grate structure upon which a log fire may be supported.

It is yet another object of the subject invention to provide a hot water heating system for homes and other buildings utilizing a fireplace boiler to supplement a conventional heating system to reduce the consumption of energy by the latter system.

Briefly, in accordance with the subject invention we provide a system for heating a home or other building which includes a furnace for supplying thermal energy to a heating medium and a fireplace boiler for heating a liquid. Means is provided for conveying the liquid from the fireplace boiler to the furnace for supplying heat from the liquid to the heating medium.

These and other objects of the subject invention will become apparent to those skilled in the art from the following detailed description and attached drawing upon which, by way of example, only the preferred embodiments of the subject invention are illustrated.

DESCRIPTION OF THE PREFERRED EMBODIMENTS

Figure 1:
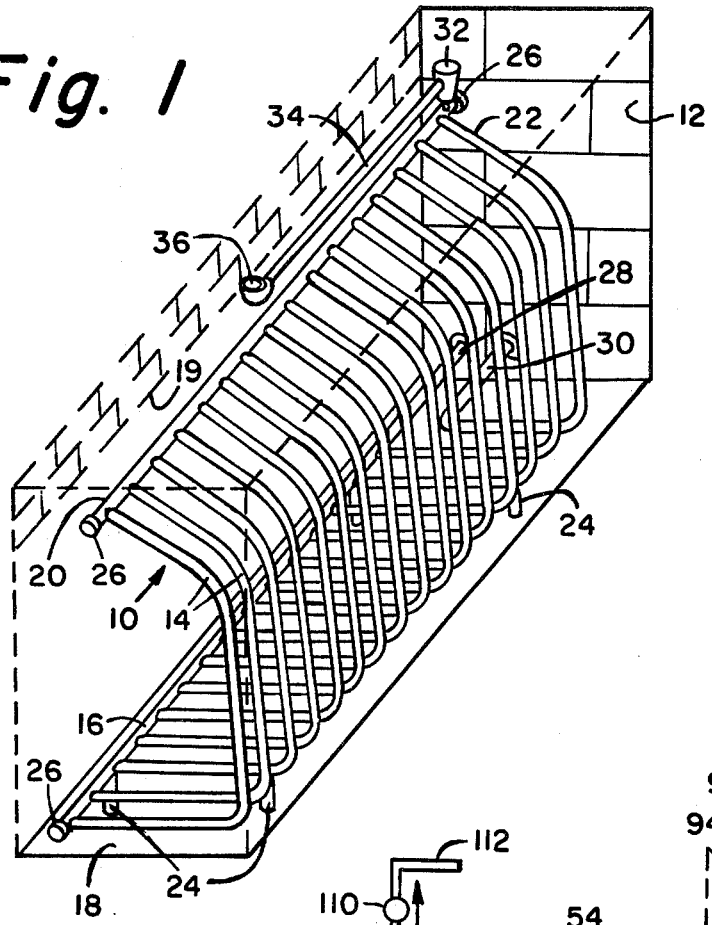
FIG. 1 is an oblique view of a fireplace boiler illustrating one preferred embodiment of the instant invention.

Referring now to FIG. 1 there is shown, in one preferred embodiment of the subject invention, a fireplace boiler 10 adapted for disposition within a fireplace 12 such as found in many homes or other buildings. The boiler 10 is constructed of a series of iron pipes 14 fashioned in the manner shown so as to form a grate upon which logs may be burned. The pipes 14 (a total of 15 in the instant example) are parallel with one another and connect along an inlet header pipe 16. The pipe 16 is disposed so as to be parallel with the front opening of the fireplace 12. Thereafter, the pipes 14 extend horizontally toward the rear of the fireplace 12 parallel with the floor 18, thence vertically upward along the rear wall of the fireplace 12 and through an arc back toward a top 19 of the front opening of the fireplace 12 where they connect to an outlet head pipe 20.

The outlet header pipe 20 is connected upon one end portion thereof to a pipe 22 adapted to convey hot water heated in the assembly out of the fireplace 12 through a sidewall thereof parallel to the inlet header pipe 16. The inlet header pipe 16 conveys relatively cooler water into the fireplace 12. The pipe 22 conforms generally to the shape of the pipes 14 thus forming an end portion of the grate structure. The resulting grate structure is supported above the floor 18 in any convenient and suitable manner as, for example, by legs 24. In the subject example, the legs 24 are formed from the pieces of iron pipe of the same diameter as the pipes 14.

The grate structure thus forms a suitable supporting means for the usual log fire. The pipes 14 and 22 thus absorb heat from direct contact with burning logs and embers along the horizontal portions thereof, and heat generated by the burning logs and embers rises vertically through the upper curved portions of the pipes 14 and 22 as it escapes through the chimney of the fireplace 12, whereby additional portions of heat are absorbed in the boiler 10. The ends 26 of the header pipes 16 and 20 are plugged, capped or sealed in any suitable and well-known manner to form a water circulating system with relatively cold water inlet at 28 and relatively hot water outlet at 30.

As an additional feature and safety precaution, a pressure relief or blowoff valve 32 of conventional type is connected on the hot side or outlet end portion of the outlet header pipe 20. It is recommended that the valve 32 be connected to the header pipe 20 near the far end thereof so as to be isolated from direct exposure to open flame and the maximum heat generated in the fireplace 12. The output side of the valve 32 is connected to an extension pipe 34 which projects parallel to and above the outlet header pipe 20 back to the approximate center thereof. On the other end of the pipe 34 there is connected an elbow 36 with the outlet end thereof turned vertically upward toward the chimney of the fireplace 12.

Should the water pressure within the boiler 10 exceed the pressure limit of the valve 32 for any reason, the valve 32 will open and hot water under pressure within the outlet header pipe 20 will be diverted to the extension pipe 34, thence out the elbow 36 to spray and quench the fire in the fireplace 10. The relief valve 32 should be selected so as to actuate at pressure levels sufficently above the design or nominal operating pressure of the boiler 10 so as not to operate unnecessarily. However, the valve 32 should operate well below the safe pressure limits of the heating system with which the boiler 10 is employed. We recommend using a valve 32 having an operating pressure limit of from 25 to 30 psi when the boiler is used in conjunction with the ordinary home heating system, although other pressure levels may be found to be more suitable for different applications.

Alternative structural configurations of the boiler 10 other than the specific geometry shown and described in the instant example may be employed consistent with our invention, but the specific structure shown is the preferred mode because of its ease of assembly, attractiveness and efficiency as a heat absorbing assembly. It is also recommended that the outlet header pipe 20 be disposed in the fireplace so as to be hidden above and behind the top 19 of the fireplace opening to enhance the attractiveness of the assembly.

In a specific model of the boiler 10 of the instant example which we have constructed and found to be highly satisfactory, we form the pipes 14 out of conventional ½ inch iron water pipes. These pipes 14 are parallel with one another, and spaced ¾ inch apart, side to side. The pipes 14 are welded to the header pipes 16 and 20 which are formed of ¾ inch conventional iron water pipes. While any number of pipes 14 may be used, we recommend using as many as possible for purposes of efficiency, preferably from 11 to 15 depending in part, of course, upon the size of the fireplace 12. Because of the geometry of the boiler 10 only the hottest water within the boiler 10 tends to rise through the pipes 14 and pass out of the fireplace 12 through the outlet header pipe 20 and the outlet pipe 22. Relatively cooler water will remain in the lower levels of the boiler 10 until heated sufficiently to rise to the outlet header pipe 20. This physical feature further enhances the efficiency of the system.

Figure 2:
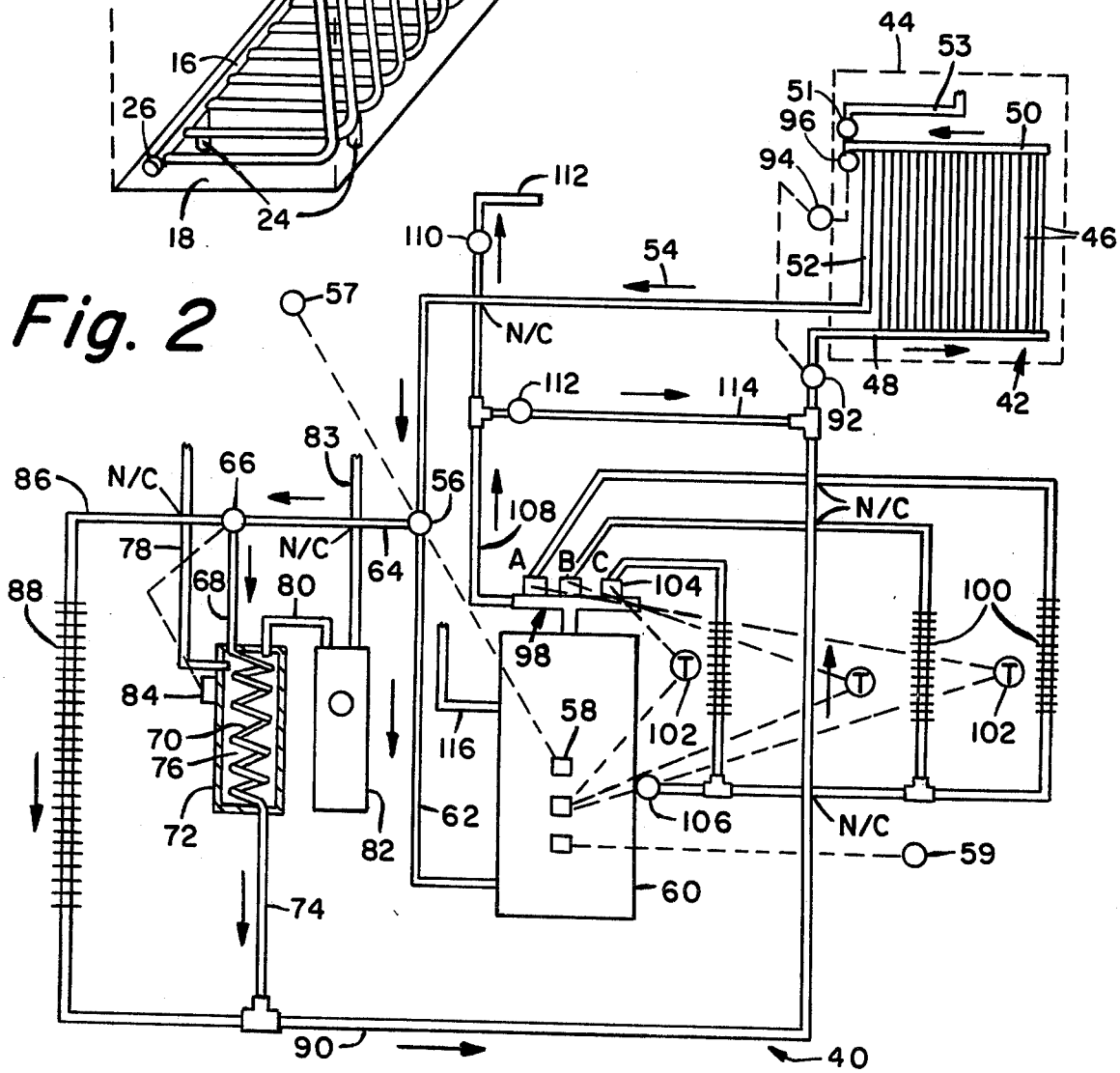
FIG. 2 is a schematic diagram of a hot water heating system for a home utilizing a fireplace boiler, thus illustrating another preferred embodiment of the instant invention.

Referring now to FIG. 2 there is shown, in another preferred embodiment of the subject invention, a hot water heating system 40 for a home which utilizes a fireplace boiler 42 of the type previously described in detail with reference to FIG. 1. The boiler 42 is disposed within the confines of a fireplace 44 and includes a series of pipes 46 forming a log grate and connected in common between an inlet header pipe 48 and an outlet header pipe 50. An outlet pipe 52 is connected to one end of the outlet header pipe 50 and conveys relatively hot water away from the fireplace 44 as indicated generally by arrows 54. Also shown is a pressure relief valve 51 attached to the output end of the header pipe 50, which is in turn connected to an extension pipe 53 for safety purposes in the manner as previously described with regard to FIG. 1.

The outlet pipe 52 communicates with a conventional three-way zone valve 56. The zone valve 56 may be actuated by a 24 volt electrical signal applied to it in the usual manner from a conventional thermostatically controlled switch 58 of the type usually found as a standard component on a conventional oil, coal or gas fired or electrically heated home furnace 60. In ordinary operation, the boiler of the furnace 60 is fired to raise the boiler water temperature to a preselected maximum value, usually about 180° F. Once the water temperature in the furnace boiler reaches that level, the furnace burner or heater shuts off and does not turn on again until the water temperature drops to a preselected minimum temperature, usually about 160° F. The valve 56 is adapted to feed hot water from the fireplace boiler 42 to the boiler of the furnace 60 so long as the temperature of the water in the furnace boiler is below 210° F.

Thus, once the boiler water temperature in the furnace 60 has reached 180° F. and the furnace burner or heater has shut down, the fireplace boiler 42 can keep the furnace boiler temperature above 160° F. so that the furnace burner or heater will not turn on. But even when the water temperature in the furnace boiler is below 160° F. for any reason, the fireplace boiler 42 contributes substantially, along with the energy source of the furnace 60, to raise the boiler water temperature therein. As a result, the water temperature is quickly raised to 180° F. where the furnace energy source shuts off, thus saving a substantial amount of energy ordinarily required to operate the conventional home furnace 60. We have found that with a medium log fire burning in the fireplace boiler 42, sufficient heat is thereby contributed to the furnace boiler to maintain the water temperature thereof above 160° F. in all but extreme circumstances such as extreme cold weather, unusual heat loss from the house, or a combination of the same. Should the water temperature in the boiler of the furnace 60 reach or exceed 210° F. or such other desired and preselected boiler water temperature limit, the thermostatically controlled switch 58 will actuate the valve 56 to divert hot water from the boiler 42 into a line 64 from whence hot water will flow through a second three-way zone valve 66. A 24 volt lamp 57 may be connected to the valve 56 in the usual manner to indicate this status.

The valve 66 is arranged to feed hot water into a line 68 and thence to a coiled pipe 70 located within a closed hot water preheater tank 72. As the hot water circulates through the coiled pipe 70 and passes out of the tank 72 through a line 74, heat is absorbed by water in a chamber 76 of the tank 72. The water in the chamber 76 is introduced from the usual domestic home water supply through a line 78. This water, preheated with the aid of the fireplace boiler 42, is then conveyed through a line 80 to the usual hot water heater 82 as is found in most modern homes. Hot water for use in the home is then supplied from the hot water heater 82 through a line 83 in the usual and well-known manner.

When the water in the chamber 76 rises to a preselected level, usually about 200° F., a thermostatically controlled switch 84 of any suitable type adapted to sense the temperature of the water in the chamber 76 actuates the valve 66 to divert hot water from the line 68 into a line 86. Hot water from the fireplace boiler 42 is thus diverted along the line 86 upon which a series of heat radiating fins 88 radiates excess heat not needed to raise the temperature of either the boiler water of the furnace 60 or the water in the chamber 76 of the preheater tank 72. We recommend that the line 86 be routed under the ground floor of the home in either the basement or crawl space if possible so that the heat radiated by the fins 88 can be recovered to some extent in heating the house. If this can not be done, then the pipe 86 with the fins 88 attached should be routed through the attic.

The fins 88 may be constructed in any suitable and well-known manner sufficient to radiate heat from the water passing through the pipe 86 such that the temperature of the water in the boiler 42 does not exceed approximately 220° F., under circumstances of normal operation, including a reasonable normal fire on the boiler 42. It is recommended that the fins 88 each be about 3 inches on a side and spaced about ¼ to ½ inches apart along the line 88. Some experimentation with the size and number of the fins 88 will most probably be required in each individual installation since so many variable factors affect the operation of the system 40 such as the insulation properties of the home and its ability to retain heat, the ambient low temperature extremes in the area where the home is located, the relative size of the home and heating capacity of the furnace 60 and hot water heater 82, etc. Even the volume of water circulated in a given example of the heating system 40 of this instant invention will affect to some degree the number of fins 88 which may be needed to affectively radiate the required amount of heat diverted to the line 86. We recommend using standard ¾ inch fin tubing for the line 86 and fins 88 such as manufactured by Edwards Engineering Company, Plainview, N.J. or the equivalent.

The heating system 40 is formed into a closed water circulating circuit by means of a cold water return line 90 which conveys water from the line 86 and/or the line 74 back to the inlet header pipe 48. Water within the system 40 is circulated by an electrically operated water pump 92 of any suitable and conventional type. The pump 92 is controlled in the usual well-known manner by a switch 94 located in a convenient place outside of the fireplace 44, which switch 94 is, in turn, actuated by a thermocouple 96 located within the fireplace 44 and attached to the outlet pipe 50 so as to sense the water temperature therein. It is necessary that the thermocouple 96 and switch 94 be selected so as to operate pump 92 when the water temperature introduced to the furnace boiler through the line 62 is higher than the temperature limit of the water in the furnace boiler at which the furnace 60 is designed to fire. Otherwise, the pump 92 might pump relatively cool water into the furnace boiler thus actually lowering the furnace boiler water temperature and causing the furnace 60 to fire. In other words under those undesirable conditions, the furnace boiler would, in affect, be supplying heat to the water in the fireplace boiler 42 rather than the reverse. When the water in the header pipe 50 drops below about 170° F., the switch 94 should be set to turn the pump 92 off.

The remainder of the system 40 of the instant invention includes those attachments ordinarily found in the conventional hot water home heating system such as zone valves 98, through which hot water from the conventional furnace 60 is circulated to a series of radiator heating elements 100 located at appropriate places in the various rooms of the home. In the actual model of the system 40 constructed by us, the home includes a three-zone hot water heating system, designated A, B, and C, each of which is independently controlled by its own zone thermostat 102. The thermostats 102 are energized by 24 volt signals from the furnace 60 in the usual manner and are independently adjustable to control switches 104 which control the flow of hot water to each zone A, B and C of the home. In our home heating arrangement, one of these zones includes the heat circulating system for the family room/kitchen area, another includes the living room/dining room area and the remaining zone includes bedroom and certain hallway areas. Cold water is returned from the zones A, B and C to the furnace 60 through an electric circulating pump 106. A pipe 108 taps water from the zone valves 98 to a bleeder valve 110 and thence to a water drain 112. The bleeder valve 110 may simply be a hand turnable valve and is used to bleed excess air from the system 40 which can accumulate over a period of time. Otherwise, the valve 110 is kept closed.

The line 108 is connected through a water turn-off valve 112 of any suitable and well-known type to a line 114 which joins the cold water return line 90 on the input side of the pump 92. The valve 112 is in an open condition to pass water therethrough when the fireplace boiler 42 is used as an auxiliary in conjunction with the furnace 60 and its associated heating system. The fireplace boiler 42 and its associated circulating system, is disconnected from the heating system of the furnace 60 when the turn-off valve 112 is closed. The ability to easily turn-off the fireplace boiler 42 and its circulating system is a particularly desirable feature since many modern furnaces are equipped to operate as an air-conditioning system in warm weather periods and are thus operative when the fireplace 44 is not. Make-up water required by the furnace 60 and the system 40 due to leakage, evaporation, water loss resulting from bleeding the system 40 of air, and the like, is provided to the boiler of the furnace 60 by a line 116 attached to the home water supply, not shown.

The hot water preheater tank 72 and its associated circuit, including the valve 66 and lines 68, 74 and 80 are an optional feature of the system 40 of the instant invention and not a required part thereof. The system 40 is thus established so as to give first preference to raising boiler water temperature in the furnace 60 for home heating purposes. If the fireplace boiler 42 is not required for this purpose as for example when the furnace boiler water temperature is 210° F. or higher, then the valve 56 supplies hot water from the fireplace boiler 42 to the hot water preheater tank 72. The preheater tank 72 and its requirements for heat is thus secondary to the requirements of the furnace 60. However, where the fireplace boiler 42 supplies more heat than required by both the furnace 60 and the preheater tank 72, the valve 66 diverts the unneeded and excess hot water to a heat sink represented by the line 86 and the fins 88 where excess heat not required by the system 40 is radiated.

The term N/C shown at various points in FIG. 2 represents pipes crossing one another without connecting together. In the specific model of the system 40 which we have constructed, the valve 56 is a conventional 24 volt hydronic valve, the pump 92 is a 120 volt, 1/20 horsepower type. The pressure relief valve 51 is a conventional 30 psi valve manufactured by Bell and Gosset.

We installed the boiler and home heating system of this invention in the home of William A. Johnson in accordance with the examples explained herein. The home contains 2,216 square feet of floor space. During the month of January, 1975 and the first 654 hours of use (27¼ days), the furnace gas burner used to fire the furnace boiler operated only 66½ hours or slightly more than 10% of the time. On Jan. 27, 1975, the gas was turned off completely and we were able to heat the home thereafter using only the auxiliary fireplace boiler to heat the water in the furnace boiler.

Under these conditions the home could be adequately heated during the day while the fire in the fireplace was tended as necessary. At night and during the early morning hours, as the fire died down, the temperature in the home dropped only 4°. Of course, the quality of insulation and the ability of the home to retain heat is an important consideration in this regard, as in all cases. Thus the system 40 can actually be employed as the primary water heating system to heat the house as well as merely an auxiliary system to supplement the furnace 60 energy source.

Figure 3:
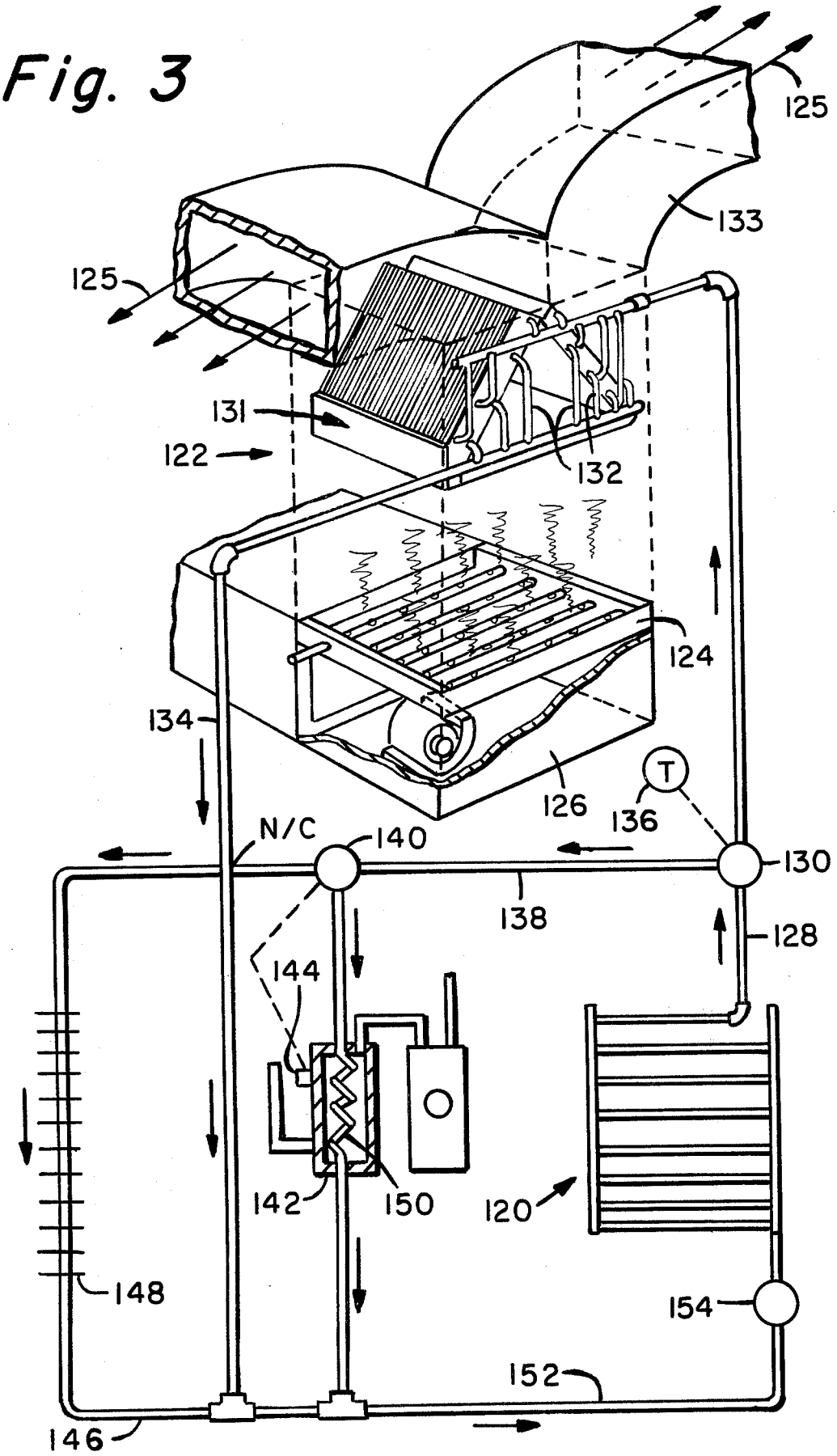
FIG. 3 is a schematic diagram of a gas fired-forced air heating system utilizing a fireplace boiler, illustrating yet another preferred embodiment of the subject invention.

Referring now to FIG. 3 there is shown, in another preferred embodiment of the subject invention, a fireplace boiler 120 such as that shown in FIG. 1 or any other suitable type, connected to a conventional forced air furnace 122 such as may be found in many modern homes or other buildings. The furnace 122 may have a primary heating element, such as a gas burner 124 of any well known type suitable for supplying thermal energy to a heating medium such as air 125. The air 125 passes through the furnace housing 126 as it circulates throughout the building to heat the same.

Water, heated in the boiler 120, flows through a line 128 in the direction indicated by arrows, through a valve 130 and into a water coil 132 which acts as a heat exchanger 131 disposed in the furnace housing 126 in the path of the furnace air heating medium, preferably below or within the furnace bonnet 133 which supplies hot air 125 to the heating ducts of the building. The heat exchanger 131 may be of any conventional type such as a Bryant Gas-Fired chiller or other well known type. As hot water from the boiler 120 circulates through the coils 132, the air passing across the coils 132 is heated. As in the previous example, the heat supplied to the furnace 122 by the boiler 120 substantially reduces the firing time of the gas burner 124. Water is returned from the coil 132 to the boiler 120 for reheating through a cold water return line 134.

The valve 130 is of conventional type and is controlled by a thermostat 136 located at a preselected position in the building being heated by the furnace 122. When the air temperature surrounding the thermostat 136 reaches a preselected maximum value, the valve 130 is switched to divert hot water from the coils 132 into a furnace bypass line 138. A second valve 140 may be placed in the line 138 to divert water to a hot water preheater tank 142 having a construction and purpose similar to the hot water preheater tank 72 of FIG. 2 as described in the previous example. The valve 140 may also be thermostatically controlled by a thermostatic switch 144 located on the preheater tank 142. Accordingly, hot water may be diverted by the valve 140 from the preheater tank 142 to a line 146 containing a series of heat radiating elements 148 when the water temperature in the tank 142 reaches a preselected maximum value.

Water introduced into the line 146 either by the valve 140 or through a coil 150 in the preheater tank 142 is returned to the cold or input side of the boiler 120 through the line 152. A conventional water pump 154 disposed on the cold water side of the boiler 120 circulates the water through the closed system. The fireplace boiler of our invention and a heating system employing the same can be used in associated with a forced air type furnace in the manner illustrated in the present example as well as with hot water furnaces such as illustrated in the previous example. The system is thus widely and readily adaptable to different types of furnaces including those which are fired by gas, oil, electricity and otherwise, and including those which generate hot water or hot air as the building heating medium.

Although the instant invention as been described with respect to specific details of certain preferred embodiments thereof, it is not intended that such details limit the scope of the subject invention except to the extent set forth in the following claims.

We claim:

1. A system for heating homes and other buildings comprising a fireplace water boiler, a furnace having a water boiler, means for conveying relatively hot water from said fireplace boiler to said furnace boiler, radiating means for dissipated heat from water introduced therein, valve means for diverting said relatively hot water from said furnace boiler to said radiating means when the temperature of the water in said furnace boiler is at least equal to a first preselected value, cold water return means for conveying relatively cold water from said radiating means to said fireplace boiler, and a water pump connected between said cold water return means and said fireplace water boiler adapted to forceably circulate water through said system when the temperature of the water in said fireplace boiler is at least equal to a second preselected value.

2. The system of claim 1 further comprising a hot water heater, a water preheater defining a chamber adapted to hold water, a coiled pipe disposed in said chamber and having an input end connected between said valve means and said radiating means for introducing relatively hot water from said fireplace water boiler into said coiled pipe, and an output end connected between said radiating means and said pump for conveying relatively cold water into said cold water return means, means for introducing water into said chamber from a source external to said system to absorb heat from said coiled pipe, means for transmitting water from said chamber into said hot water heater, and second valve means connected between said first valve means and said radiating means for diverting said relatively hot water from said coiled pipe to said radiating means when the temperature of the water in said chamber is at least equal to a second preselected value.

3. The system of claim 1 further comprising hot water circulating means attached to said furnace for heating said home and other buildings, and means connecting said circulating means between said radiating means and said pump.

4. The system of claim 3 further comprising a water turn-off valve attached to said connecting means for passing water between said circulating means and said pump when said fireplace water boiler is operative and for prohibiting the flow of water from said circulating means to said pump when said fireplace water boiler is inoperative.

5. The system of claim 3 further comprising an air bleeder valve connected to said circulating means for removing air accumulated therein.

6. The system of claim 1 further comprising switching means for turning said pump on and off, and a thermocouple attached to said fireplace boiler responsive to the temperature of the hottest water therein and operatively associated with said switching means for energizing said pump to an operative condition when the temperature of said hottest water is at least equal to a third preselected value, and for deenergizing said pump, to an inoperative condition when the temperature of said hottest water is less than said third preselected value.

7. The system of claim 1 wherein said radiating means comprises a water pipe, and a plurality of heat radiating fins attached to said pipe.

8. The system of claim 1 wherein said radiating means is disposed under a ground floor of said house or other buildings for radiating heat upward therethrough.

* * * * *